US005559575A

United States Patent [19]

King

[11] Patent Number: 5,559,575

[45] Date of Patent: Sep. 24, 1996

[54] EDGE-BELT FILM HANDLING SYSTEM FOR FILM PROCESSORS AND ACCUMULATORS

[76] Inventor: Roger A. King, 300 Wrenco Heights, Sandpoint, Id. 83864

[21] Appl. No.: 383,197

[22] Filed: Feb. 3, 1995

[51] Int. Cl.[6] ..... G03D 3/08

[52] U.S. Cl. ..... 354/320; 226/172; 226/189; 226/196; 271/205

[58] Field of Search ..... 354/319–324, 354/339, 340, 345, 344; 226/61, 81, 82, 83, 173, 189, 172; 271/75, 206, 205, 272, 277; 198/345.3, 465.3, 586, 626.1, 848, 850, 817; 414/278

[56] References Cited

U.S. PATENT DOCUMENTS

| | | | |
|---|---|---|---|
| 1,991,137 | 2/1935 | Case et al. | 271/75 |
| 3,019,855 | 2/1962 | Engle | 183/62 |
| 3,240,412 | 3/1966 | Zygan et al. | 226/82 |
| 3,323,703 | 6/1967 | Wibbing et al. | 226/173 |
| 3,398,871 | 8/1968 | Ungerer | 226/173 |
| 3,881,229 | 5/1975 | Reid | 226/61 |
| 3,931,881 | 1/1976 | Bickel et al. | 198/165 |
| 4,014,428 | 3/1977 | Ossbahr | 198/345 |
| 4,190,185 | 2/1980 | Thate | 226/172 |
| 4,542,820 | 9/1985 | Maxner | 198/817 |
| 4,643,129 | 2/1987 | Sari | 118/641 |
| 4,889,070 | 12/1989 | Sari | 118/64 |
| 4,929,976 | 5/1990 | Cunningham et al. | 354/322 |
| 5,243,373 | 9/1993 | Glover et al. | 354/320 |
| 5,317,358 | 5/1994 | Kawada | 354/319 |

*Primary Examiner*—D. Rutledge

*Attorney, Agent, or Firm*—Schwegman, Lundberg, Woessner & Kluth, P.A.

[57] ABSTRACT

A system for transporting film through photographic-type processing uses a pair of flexible belts which have grooves to receive and guide the edges of the film in loose frictional engagement, and a drive and support system for moving the belts and film through a processing step. The groove in the belts is larger than the thickness of the film such that a particular place on a film edge is not tightly contacted, yet there is enough contact, and varying points of contact along the film, so that over an extended length of film there is sufficient frictional engagement to control and transport the film. Multiple stage processes have separate belt-drive systems, with aligned take-up and unload zones wherein the belts are moved into or away from contact with the film, to effect automatic handoff of the film to succeeding stages. An accumulator is provided at the end of the process, to receive and hold the film(s) on a first in, first out basis. A pair of flexible belts move the film between a pair of hoops in a loose roll, and older films can be removed from the open center.

20 Claims, 14 Drawing Sheets

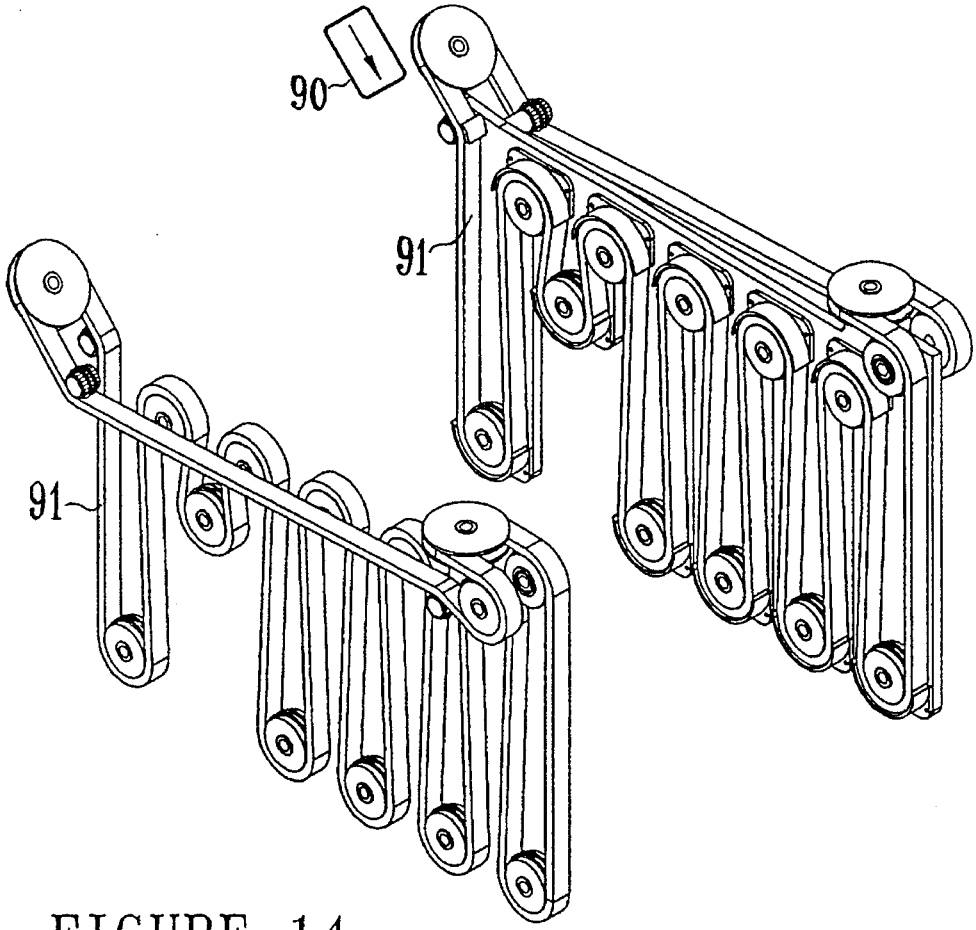
FIGURE 14
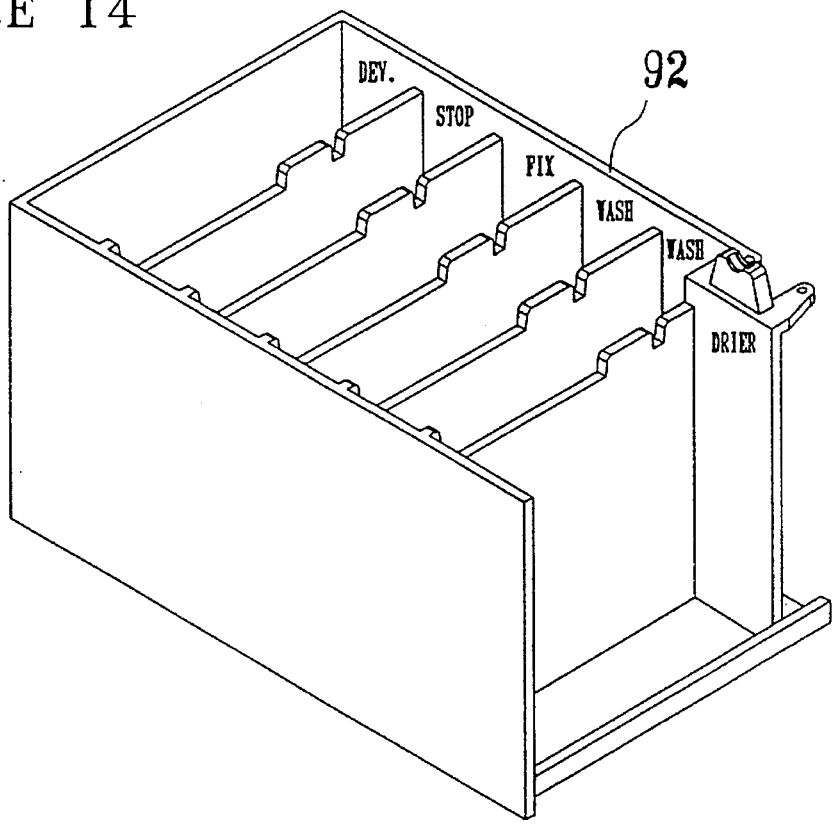

EDGE-BELT FILM HANDLING SYSTEM FOR FILM PROCESSORS AND ACCUMULATORS

TECHNICAL FIELD

This invention relates to systems and methods for the handling of film, such as photographic or X-ray film, during and after the various steps of processing or development. In particular, the invention pertains to a unique belt system in handling film by its edges, and an accumulator for receiving and safely holding processed film exiting a processing machine.

BACKGROUND OF THE INVENTION

Automatic film processing machines presently in use in the industry utilize various mechanisms to move the film strip through the various processing steps. These include various types of roller transports, systems which rely on clamping the end or sides of a film strip, and leader-belt, leader-card and cine style processors. Although such prior systems are for the most part successful in handling films being processed, they are subject to a number of disadvantages and problem areas in which improvements would be desirable. These include the potential for damaging areas of film due to contacting the film or image area. This is especially true with fine microfilms which have very thin emulsions that are easily damaged by rough handling or contact. Also, systems which clamp the film by the edges, to avoid the central image area, do not entirely solve this problem. The contacted areas do not develop, which is a problem with school-type film in which data is recorded out to the edges of the film, it is also a problem with other types of film, because of uneven development adjacent the contacted areas which can extend out into the image.

Other problems with existing film transport systems involve the excessive carrying-over of chemical from one bath to the next, and retention of chemicals which can build up residues, requiring frequent down-time for cleaning. The large size of some processors, and the great number of components and moving parts lead to significant costs, both in original manufacturing cost and in the costs of operation and maintenance.

The use of an edge-belt for holding and transporting film has been proposed in the prior art, but it is believed such proposals were not particularly successful, and have not achieved significant use in automatic processing machines. In gripping the film along an edge, such early belt systems were subject to the problems of, zones of non-development and uneven development, and film damage due to contact along the edge and problems in control of tension in the gripping force.

SUMMARY OF THE INVENTION

To overcome these and other problems and shortcomings existing in the prior art, the present invention provides a new method and system for film transport through the use of flexible belts which have grooves to receive and guide the edges of the film in loose frictional engagement. The groove in the belts is larger than the thickness of the film such that a particular place on a film edge is not tightly contacted, yet there is enough contact, and varying points of contact along the film, so that over an extended length of film there is sufficient frictional engagement to control and transport the film.

According to the present invention there is provided a system for transporting film in a process, including a pair of flexible belts having grooves to receive the edges of the film. A system of belt supports holds said belts in spaced relation according to the width of the film and moves the belts in a film path in and through the process. The grooves are sized to receive the film edges in loose frictional engagement, so that the film may be moved guided and transported in said process by movement of said belts without direct clamping.

According to one feature of the invention, the belts are made of a flexible rubber material, and include a tension member formed therein and internally secured to resist stretching or bunching of the rubber. In a preferred form, the belts have equal flexibility in perpendicular planes so as not to twist when bent in different directions, as they are moved through a process and twisted in different directions.

In a preferred form, the belts have cog teeth on their sides and the belt support system includes geared wheels for engaging the cog teeth. The belts are in loops, and the belt support system directs the film path not only through the chemical process container, but also through load and unload zones before and after the process step. In the load zone the belts are brought from a wide relationship toward film-width and into film edge engagement, so as to take the film and guide it throughout the process step. In the unload zone after the process step, the belts are spread apart by the belt support system, and away from film edge engagement to discharge the film. Preferably, each step in the process has its own processing step (i.e., chemical tank, or film drying or the like), and belts and belt drive system, with their respective load and unload zones adjacent one another and aligned for automatic handoff of the film to each succeeding process step.

According to another feature of the invention, an accumulator is provided for receiving and storage on film strips exiting the last step on a first-in-first-out basis. This allows films to be temporarily held by the machine until needed for printing, without subjecting it to the risk of damage by manual handling or dropping into a box or other container.

BRIEF DESCRIPTION OF THE DRAWING

FIG. 14 is a view of the transport system configured for a dental X-ray processor.

DETAILED DESCRIPTION OF THE PREFERRED EMBODIMENTS OF THE INVENTION

Figure 1:
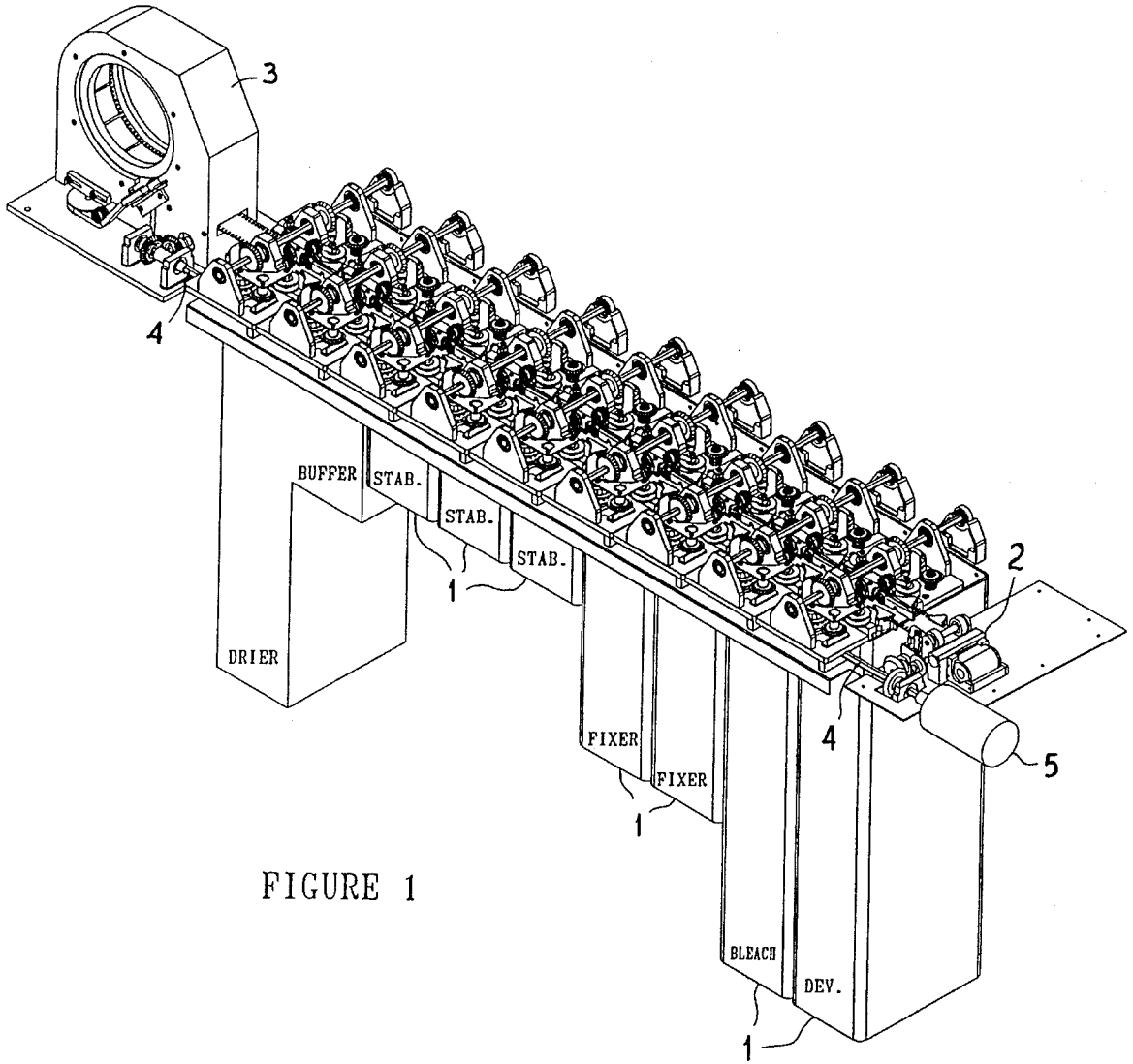
FIG. 1 is a view in perspective showing a complete multi-step film processing system using the film transporting system and film accumulator of the invention.

Referring to the drawings and particularly to FIG. 1, there is shown a drawing of the complete transport system and solution tanks for a film processing system known in the photo industry as color negative process C-41B. The overall system consists of a series of tanks 1 of different lengths containing the various chemical solutions required to convert the latent image on the photographic film into a visible image.

The system contains a loading station 2 where the film is extracted from its container and fed into the processor. After processing and drying, the film is rolled up for temporary storage-in a device known as an accumulator 3. The details of the loading station are not included as part of the detailed description of the film transport invention.

The solutions are held at a precise temperature and the films are carried from tank to tank by the transport system. The time in the solution determines the amount of chemical action that takes place on the film. All solutions are normally circulated, filtered and replenished continuously as film is being processed. For proper processing, it is necessary for the chemical solutions to be brought frequently and uniformly to all surfaces of the film. Photographic films become wet and warm during the process and the image-carrying emulsion becomes soft and easy to scratch and damage if proper care is not exercised. The processing solutions are also very sensitive to contamination by other solutions and are degraded by the carryover of one solution to the next by the solution remaining on the film or any parts of the transport that may also be going from tank to tank. The entire transport system is driven by one common drive shaft 4 and a drive motor 5.

Figure 2:
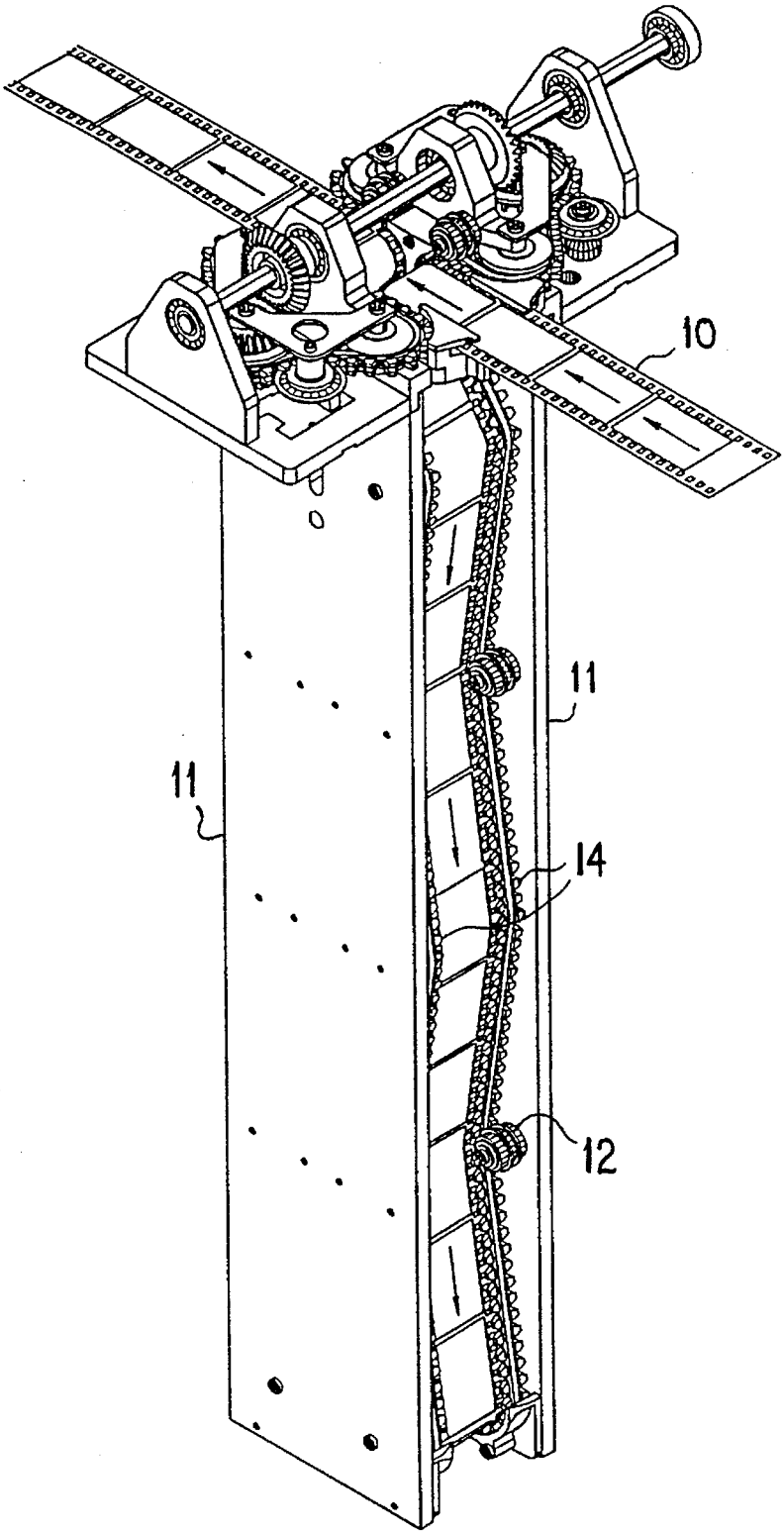
FIG. 2 is an view showing one transport rack of the system of FIG. 1, removed from its solution tank.

Referring now to FIG. 2, there is shown one of the typical transport racks removed from its tank. Film 10 is shown entering and exiting the transport rack in the directions indicated by the arrows. The transport rack consists of a drive mechanism assembly (described below) mounted to the top of a pair of side plates 11. The side plates 11 can be identical or mirrors of each other depending to the particular situation required in the processing tank. A number of small idler rollers 12 and large idler rollers 13 (They are hidden behind the film in this drawing) are mounted on the inner surfaces of the side plates to establish the path for the transport belts 14.

Figure 3:
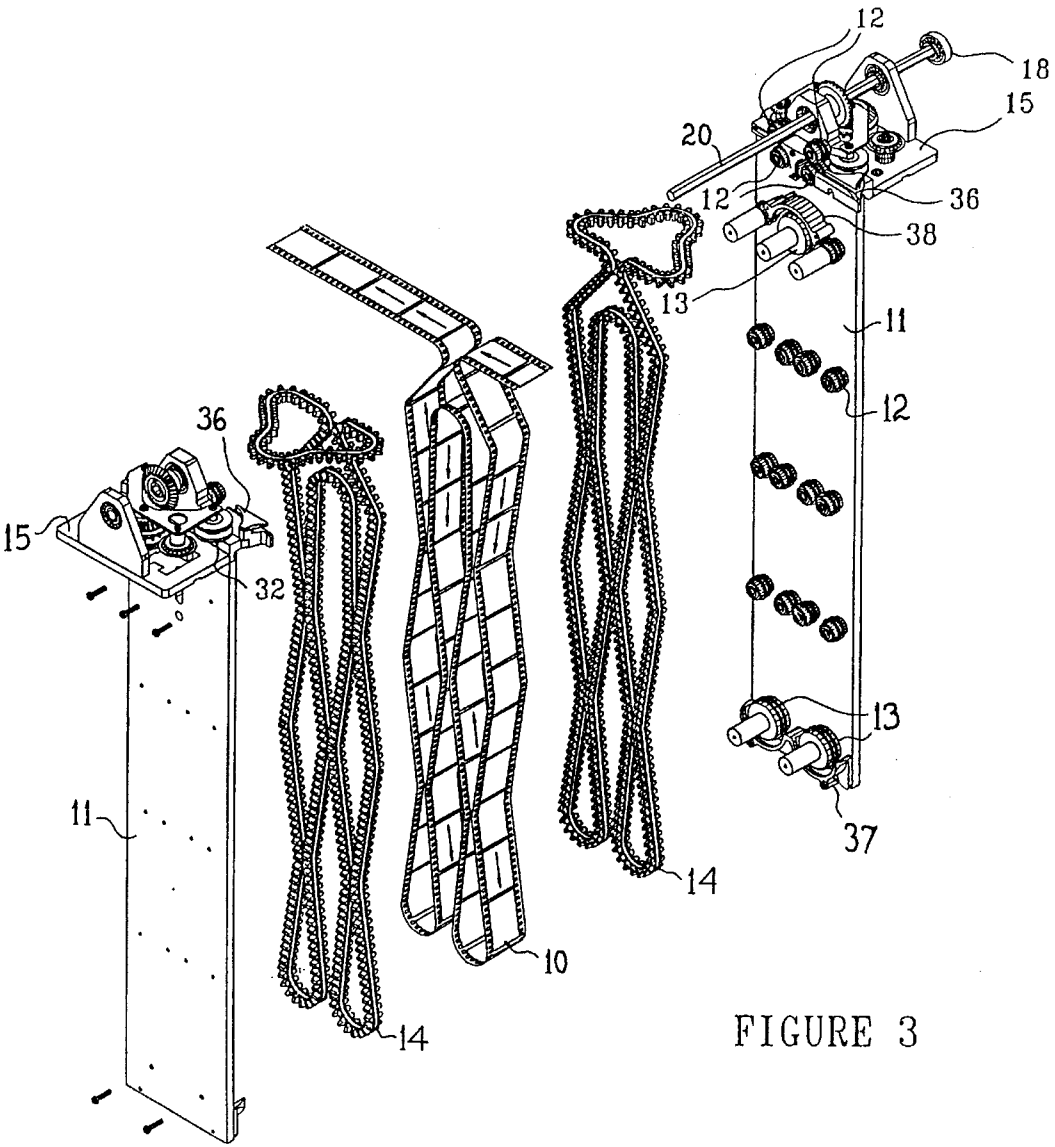
FIG. 3 is an exploded view of the assembly of FIG. 2.
Figure 4:
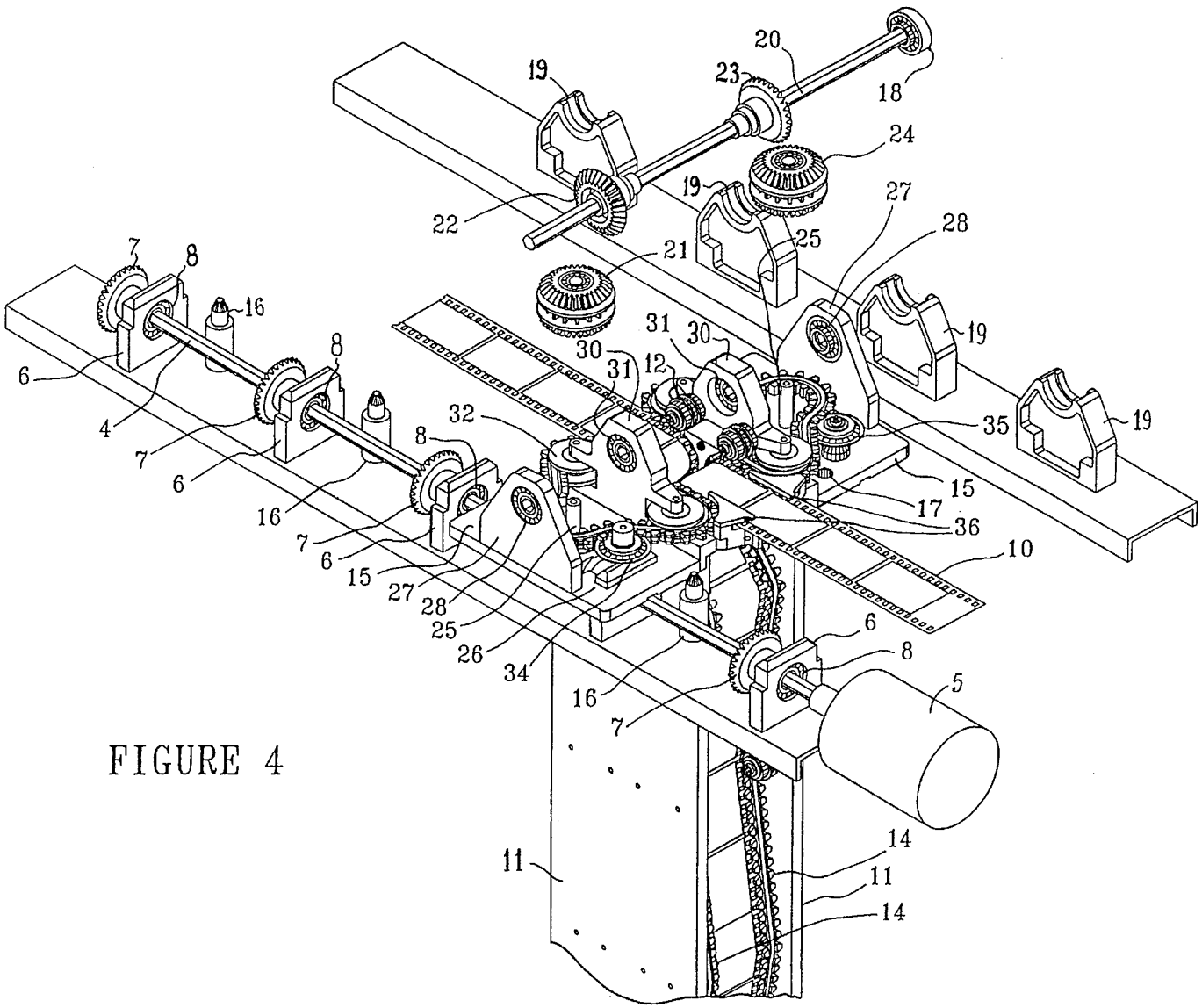
FIG. 4 is an exploded view of the drive assembly including the load and unload zones for a transport rack.
Figure 5:
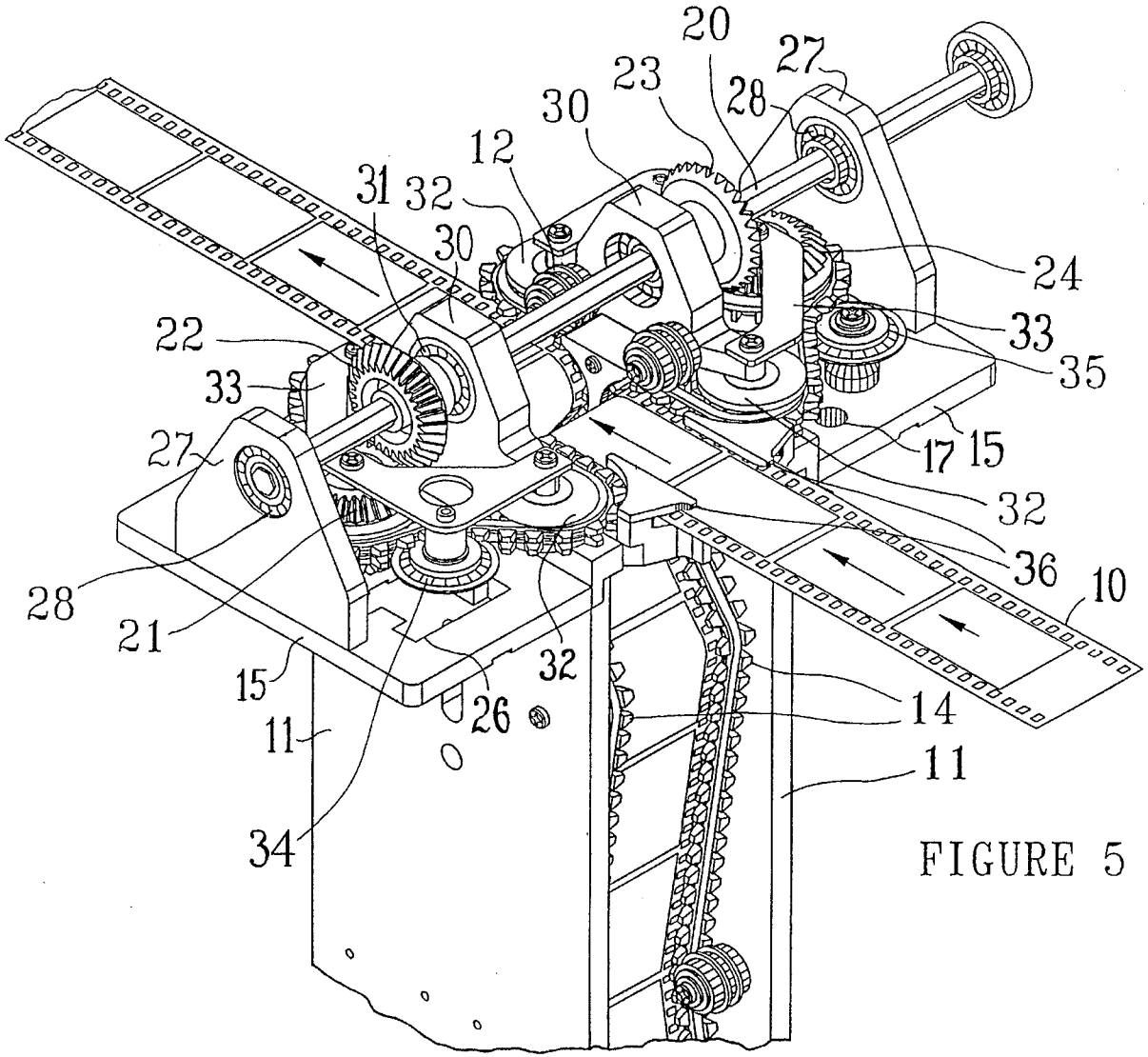
FIG. 5 is a view at an enlarged scale of the drive assembly of FIG. 4.

Referring now to FIGS. 3, 4 & 5, there are shown exploded views of the drive mechanism assembly and a close up of the assembly. The driveshaft 4, shown in FIG. 4, is aligned with the framework of the processor by a series of bearing holders 6 that also serve as alignment tabs and supports for the drive mechanism base decks 15. A shouldered miter gear 7 is supported by a bearing 8 at each of the bearing holder/alignment tabs 6. The driveshaft 4 shown in this embodiment is a shaft of hexagonal profile and the bore of the miter gear 7 is a hex bore which closely fits the drive shaft to provide a positive drive and not require the use of set screws or other fastening devices. A miter gear/bearing holder/alignment tab 6 is located at each processing tank 1 to provide the input power to drive the transport rack assembly that will operate at that particular station of the process. Further positioning and alignment of the mechanism deck is provided by an alignment pin 16 that engages an alignment hole 17 on the deck. The side of the transport mechanism opposite the driveshaft is supported by a bearing assembly 18 that rests in the pocket of the outboard bearing support 19. Parts 6, 16 and 19 create a three point mounting system to insure accurate and repeatable alignment of the transport rack so that it may be removed for cleaning and servicing and precisely returned to its correct position.

It should also be noted that the crossover driveshaft 20 has a hexagonal profile and fits into the hex bore of the various gears and bearings that are located along the driveshaft. The design allows the transport racks to be made in various widths or in an adjustable style to handle multiple widths of film. The hex profile crossover driveshaft 20 allows power to be picked up at any position along the usable width of the transport path and not require the use of any fasteners to attach the gears to the driveshaft.

Following the input power from the drive motor 5 and down the driveshaft 4, to a miter gear 7 where it is transmitted into the bottom gear of a combination miter gear/sprocket/miter gear 21. The number of teeth on all of the miter gears used on the driveshaft 4 and the miter gear/sprocket/miter gears 21 is identical to insure that all parts of the mechanism turn at the same speed. Power from the top of the miter gear/sprocket/miter gear 21 is then transmitted into a miter gear 22 with a hex bore that is installed on a hex-profile crossover driveshaft 20. Power is then transmitted along the crossover driveshaft 20 to another identical miter gear 23 installed on the driveshaft 20 with the second miter gear installed facing the opposite direction from the first. Power is then transmitted from miter gear 23 into the top of another miter gear/sprocket/miter gear combination 24 identical to the combination 21. If one were to look down on the top of this device, the rotation of the drive shaft 4 would cause the sprockets on 21 and 24 to turn in opposite directions to each other and at the same speed as the driveshaft 4. The miter gear on the bottom of the assembly 24 is not used for any purpose but is retained as a convenience in assembly and manufacturing.

Referring now to FIG. 4, the power train described above is assembled on a mirrored support structure consisting of number of parts. The first part is the deck 15 and provides a surface to locate the miter gear/sprocket/miter gear 21 and 24 mounting studs 25. The deck 15 contains a tab alignment hole 26 to mate with alignment tab 6. The deck contains a peg alignment hole 17 to mate with alignment peg 16. An alignment peg 16 is located on the main frame of the processor at each tank location in a specific relationship to the alignment tab 6 so as to correctly position the transport rack assembly with respect to the driveshaft 4 and the input miter gear 7. The deck 15 provides a mounting surface to locate a bearing support 27 and bearing 28 for the end of the crossover drive shaft 20.

The decks 15 are attached to the side plates 11 and to the headstocks 30. The headstocks 30 provide a number of functions. The headstocks contain the bearings 31 that support the crossover driveshaft 20 and miter gears 22 and 23. The headstocks also provide a place to mount the horizontal turn pulleys 32 which are free to rotate around their central axis on their own internal bushings. The headstocks also provide the surface for mounting the stiffener brackets 33 (shown in FIG. 5) which carries the engagement idler roller 34. The engagement idler roller 35 on the opposite deck is mounted on a support which is part of the deck 15. The purpose of the engagement idler rollers 34 and 35 is to keep the transport belts 14 positively engaged in the sprocket portion of the miter gear/sprocket/miter gears 21 & 24. The headstocks 15 also provide a place for the mounting of the crossover guides 36. The crossover guides 36 create a type of funnel that guides the film 10 as it exits one transport rack and enters the next transport rack and insures that the film is properly centered in the mouth of the transport belt 14.

Figure 6A:
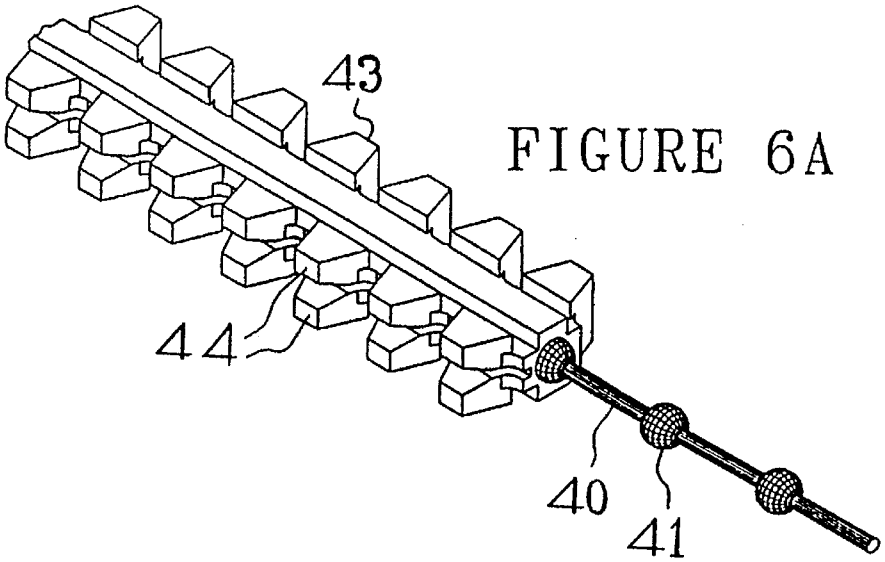
FIG. 6A is a view of a fragment of a transport belt, showing features and details thereof.
Figure 6B:
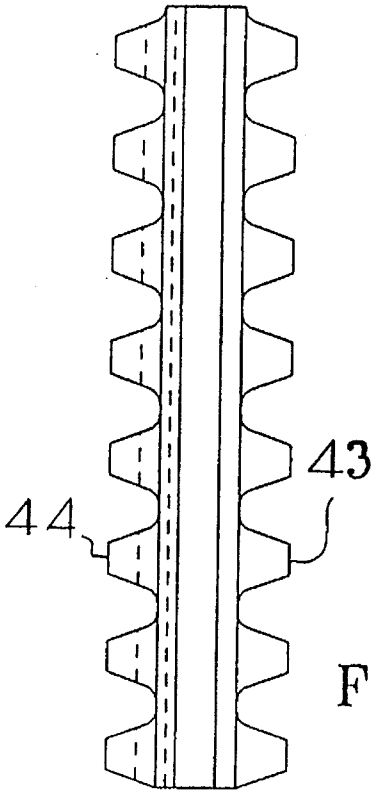
FIG. 6B is a plan view of a portion of a transport belt.
Figure 6C:
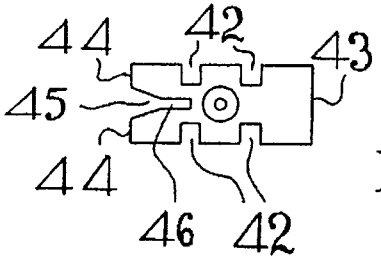
FIG. 6C is a cross section view of a transport belt.

FIGS. 6A, 6B & 6C, show the shape and configuration of the transport belt 14. The transport belts may be molded from any material that will survive the corrosive environment of the photo processing chemicals and yet stay flexible with time. The belts must not take on a set when left wrapped around a pulley or sprocket for an extended period of time. The belt material must be capable of being joined into an endless loop with joints that do not degrade with time or cause any changes in thickness or stiffness of the belt at the joint. Certain families of silicone rubbers have been found to have these properties. Two specific materials are DOW CORNING-Tooling Elastomer SG and DOW CORNING Silastic J RTV Silicone Rubber.

The transport belts 14 have a number of important elements. The first important element of the belt shown in FIG. 6A is the central tension member 40. The purpose of this tension member is to insure that the belt cannot be stretched under its normal operating conditions. If the belt is allowed to stretch during operation, the film will start creeping along in "inch worm" fashion and create a compression force on the film that causes the film to pop out of the transport belts. Tension members may be made of materials such as nylon, polyester or other synthetic fibers that are straight, woven or braided into a stretch resistant cord.

The belts also need a type of restraint to keep the soft rubber from being bunched up along the tension member. This restraint is provided by a molded ball 41 or similar shape firmly attached to the tension member. The combination of tension member 40 and restraint 41 must not affect the bending action of the belt in both of the two working planes that the belt operates in. A material such as metallic bead chain may be suitable in some operations.

The shape of the belt provides many functions. First of all, the profile of the belt must be such that it has equal bending moments in both directions since the transport belt operates in two planes that are 90 degrees to each other. A belt that does not have equal bending moments will tend to roll over as it changes planes rather than making the transition bend smoothly. The bending moment in the horizontal plane is determined by the size, shape and spacing of the notches on the edges of the belt as well as the width and the thickness of the section of the belt. The bending moment in the vertical plane is determined by the section thickness, size and positioning of the tracking grooves 42 shown in FIG. 6C and the overall width of the bendable material.

Another important detail of the belt profile are the drive cogs 43. All along one entire edge of the transport belts 14 are solid rubber cogs 43 that in effect create an endless rack for a rack and pinion drive system. The cogs engage with the sprockets that are the center sections of the miter gear/sprocket/miter gear 21 and 24 assemblies. The rack is a flexible one since it has to change planes and directions many times as it traverses its path around the transport rack. All of the power used to move the transport belts around the transport rack is applied through the drive cogs 43 by the drive sprocket assemblies 21 and 24. The engagement idler rollers 34 and 35 are positioned such that they make sure the transport belt 14 stays firmly seated in the drive sprockets 21 and 24.

Other important details of the transport belt 14 are the sets of tracking grooves 42 located on the top and bottom surfaces of the belt. These grooves engage with the ridges on idler rollers 12 and 13. As the belt makes its circuit of the transport rack, the set of ridges on the idlers and set of grooves in the belt defines the path that the belt must take. The depth and positioning of the tracking grooves 42 also determines part of the flexing properties and the stiffness of the film support teeth 44.

An important detail of the transport belt 14 is the set of film support teeth 44. These teeth provide part of the support system and part of the friction drive surface that carries the photographic film through the transport rack. Looking at the end view of the belt shown in FIG. 6C, it can be seen that the inner surfaces of the film support teeth create a "V" shaped opening 45 into the edge of the belt which leads to the film support groove 46 that is part of the central body of the belt itself. The film support teeth 44 do not grip the film nor do they engage in the sprocket holes of the film. In the assembled transport rack, shown in FIG. 5, the pair of transport belts are spaced latterly such that there is a gap between the edge of the film 10 and the bottom of the film groove 46 of at least 4 thicknesses of film (approximately 0.020 inches). This allows the film to float freely from side to side within the film groove 46 and allow the chemicals to treat the film emulsion completely across the surface. The size, shape and positioning of the film support teeth are also an integral part of the control of the bending moment of the transport belt in the horizontal plane.

The final detail of the transport belt 14 is the film groove 46. This groove also provides part of the film support area and part of the friction drive surface that carries the photographic film through the transport rack. The film support groove 46 does not squeeze or pinch the film in any way. The groove opening is at least 4 film thicknesses greater than the thickness of the film (typically 0.025 inches).

Referring back to FIG. 3, the exploded view of a transport rack shows the mirrored shapes that the transport belts 14 make when they are threaded in the rack assembly. The belts make a turn in the horizontal plane when they pass around the horizontal turn pulleys 32. As the turn is being made around the pulleys 32, the film support teeth 44 and the film groove 46 create an opening that will allow the film 10 to enter into the gap between the two transport belts 14. The crossover guides 36 provide a static guide to insure that the film is in the correct position as it enters the transport belts 14. The frictional contact of the film against the film support teeth 44 and the film groove 46 will carry the film along in the direction of travel of the belt. The belt next encounters a series of small idler rollers 12 that causes the belt to make a turns in the vertical plane.

Photographic film has "plastic memory" which means that it wants to return to the original shape as it was manufactured. In this case, it means that the film wants to return to a flat and straight condition. This plastic memory phenomenon is used to advantage because the film tends to want to continue in a straight line while being transported. When the transport belts 14 round a corner, the film prefers to keep going in a straight line but finds itself encountering the far side of the film groove 46. The transport belt only has to travel a short distance before it encounters another idler pulley 12 or 13. The film wants to continue on in a straight line and finds itself running into the outside of the film groove 46 on the opposite side of the groove as it turns the next corner. This movement from side to side within the film groove 46 has several beneficial effects. First, it causes a pumping action at the edges of the film that causes fresh chemical solution to be brought all the way out to the edge of the film and assures uniform chemical treatment all across the surface from edge to edge. If the transport belt were to grip or pinch the surfaces of the film, the film surface would be masked from the chemicals and incomplete processing would result which is undesirable and unacceptable. The second beneficial effect is that the frictional contact points between the film and the transport belts is constantly changing. This constant changing action assures that no large forces are ever applied to a concentrated point on the film which could cause mechanical damage as well as the chemical masking effect in other areas as was previously noted.

Now looking at the system as a whole, the film 10 exits the film cassette at the loading station 2 and enters the crossover guides 36 of the first transport rack which is in the developer tank. The film being carried by the belts is taken down into the developer solution where the chemicals treat the surfaces of the film. The film approaches the bottom of the tank after the belt has been deflected a few times by the idler pulleys 12 causing the pumping action between the edge of the film and the film groove 46. Near the bottom of the transport rack there are two large idler pulleys 13 centered in a turn guide 37. The purpose of the turn guide 37 is to make sure the film stays in the gap between the belts 14 as they turn the bottom corner. The plastic memory characteristic of the film makes the film want to keep on going in a straight line and to shoot right out between the teeth of the belt as it rounds the corner. There is a small gap between the outside diameter of the transport belt 14 and the inside diameter of the turn guide 37 during normal running conditions. When the leading edge of the film comes along and tries to deflect the film support teeth 44 out of the way, the turn guide 37 prevents the teeth from being deflected far enough to loose control of the film. The outer most tips of the film support teeth 44 rub against the inside lip of the turn guide 37 as the leading edge of the film rounds the corner. After the film makes the turn, the film rides nicely in the film support groove 46 and the film support teeth 44 no longer contact the turn guide.

The film is then transported upward by the transport belts through the series of small idler rollers 12 until it approaches another large idler pulley 13 surrounded by a single turn guide 38 which provides the same function as the previous turn guide 37. The small idler rollers 12 also provide the function of controlling the spacing between the belts as they travel along the path and prevents the belt from wanting to roll or twist which could cause the film to slip out from between the belts. The sequence continues until the film comes to the top of the tank on the final pass. When the film nears the exit of the transport rack, the belts 14 make a 90 degree turn into the horizontal plane on the horizontal turn pulleys 32. The transport belts in effect peel away, one to the right and one to the left and the film continues to travel straight forward.

Figure 7:
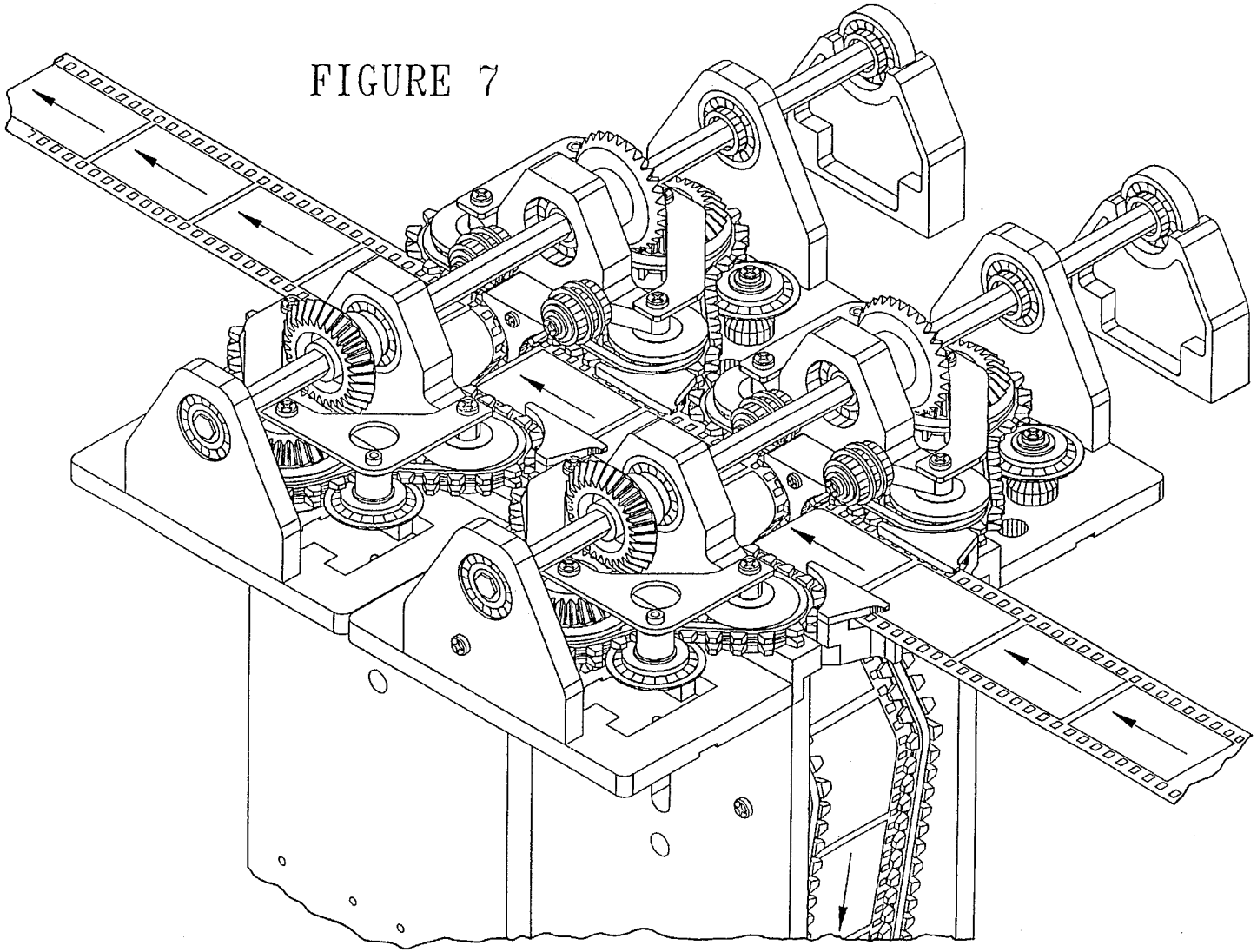
FIG. 7 is a view similar to FIG. 5 but showing a pair of transport racks representing successive stages of a multi-step process.

The next step in the photographic process shown in FIG. 1 is the bleach step. The film leaving the exit of the belt on the developer transport rack enters the crossover guide 36 of the bleach transport rack. The crossover guides 36, guide the film into the openings of the belts of the next transport rack and the next transport rack picks up the action. FIG. 7 shows the details of two transport racks positioned in line with each other and handing the film off from one rack to the next.

Figure 8:
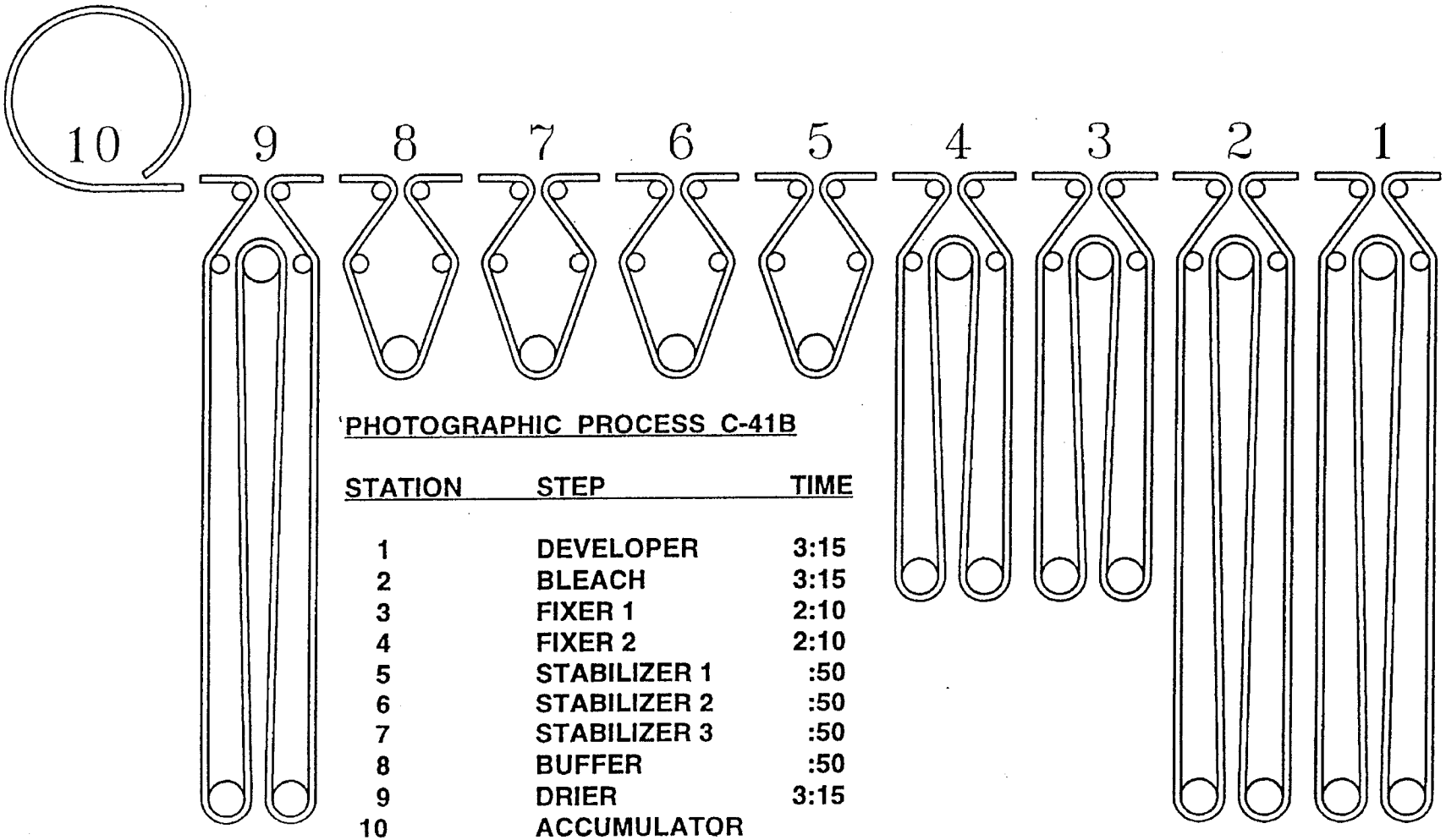
FIG. 8 is a diagrammatic representation of the film processing path for photographic color negative process C-41B.

All of the steps of photographic processes are not identical in length of time. These differences are accommodated by two prime methods. The first is to make the belt paths of various lengths. The second is to make a single pass for the very short steps. Some of these combinations are more clearly shown in FIG. 8 which is the processing path for photographic color negative process C-41B.

The processing sequence continues until the film has traveled through all of the chemical treatment steps and goes through a heated-air drier section before the film exits. The film loading station 2 has a tension sensor which detects the end of the film in the cassette and automatically cuts the film at the end of the roll.

When photographic film goes through a drier, the film wants to curl toward the emulsion (image) side of the film. The curl can be either in the lateral or transverse direction depending on how the film is restrained. With the belt transport system, another nice benefit, function and feature is that the zigzag path of the belt causes the film to take on the shape somewhat similar to the core of corrugated cardboard. The path with several turns prevents the film from curling in the lateral direction and the belts control the curling in the transverse direction. The film gets flexed several times in the transverse direction as it is traveling through the drier which tends to cancel out the tendency of the film to curl as much in the transverse direction. The film tends to exit the drier straight and flat.

It will be appreciated from the above description that the invention provides a number of advantages and benefits, as compared to prior art film handling systems:

1) The film is always handled only by the edges during transport. This prevents any contact with the critical image area surfaces.

2) The small physical size of the belt and its guidance system allows the film to make multiple passes in a small tank. By comparison, a traditional roller transport machine would require a tank at least 4 times the size to handle the same amount of film.

3) The number of mechanical components required to handle the film is cut by a factor of more than 8 in comparison with a roller transport processor.

4) Nothing other than the film ever passes from tank to tank which reduces the chemical carry-over and solution contamination. Leader-belt, leader-card and cine style processors rely on belts, cards and leader stock to transport the film through the processor. These devices lead to unnecessary dilution and contamination of the processing chemicals that is prevented by the use of the edge-belt transport system.

5) The edge-belt transport system has the unique ability to "handoff" the film from transport rack to transport rack. The handoff is accomplished without the use of any grippers, clamps, pinching devices or any external mechanisms that is required to open and close the path for the film. The opening and closing of the film path is accomplished by having the unique belt shape turn a series of corners as well as changing planes.

6) The film is continuously transported without ever being pinched or clamped at any point which would produce masked points that would not be completely be processed.

7) The film is transported by light frictional contact between the film and the film support groove at numerous contact points along the path. The contact points are constantly changing which encourages the frequent exchange of processing solutions for uniform edge to edge processing.

8) There is nothing in the film path at any point that can ever come into contact with the image area of the film to cause scratching, mottling, or physical damage to the sensitive photographic emulsion.

9) The edge-belt transport system can retain positive control of the film in any position whether it be horizontal, vertical, edgewise or even inverted.

10) Individual transport racks can be removed from the processor at any time other than when it is in the process of receiving or handing off the film.

11) The transport is designed with all of the drive portions of the transport racks being identical. Various step times are accomplished by varying the lengths of the belt paths that reach down into the processing chemicals.

12) Maintenance is very low with the edge-belt transport system since there are no areas that build up dried chemicals or other residue that can come in contact with the image area of the film. Most traditional film processors have to go through a critical nightly shut-down, wash-down procedure to prevent dried chemicals from damaging films that will be processed first thing in the next morning.

13) The transport racks are designed to be converted to different widths of films and an adjustable width mechanism is also possible to vary the width of the transport path.

The next part of the invention being described below is known as a FIFO (First-In, First-Out) accumulator and is used at the exit of a photographic film processing machine to manage and protect the film after it has been chemically processed and dried.

After chemical processing and drying, photographic film needs to be managed and protected before the remainder of the steps are accomplished. A practice common to the photo industry is to have a box-like container at the exit of the drier to receive the processed film. The film exits the drier with the leading end of the roll of film going to the bottom of the box and the remainder of the roll will pile up on top of it. The subsequent rolls of film follow suit and stack themselves on top of what is already in the box.

A processed roll of 36-exposure film is approximately 6 feet long. A typical lab will be processing a wide variety of film rolls from 6 exposures to 72 exposures as well as process control strips which are less than 12 inches long. Many of the professional processing labs also have the need to process rolls of 35 mm film that are 50 feet or more in length.

The first problem experienced with the traditional system is that it is easy to damage the film since its surfaces are sensitive to scratching. The movement of the film entering the box can cause scratching and more often, the process of getting the films separated and removed from the box can easily lead to accidental damage. Scratches show up as lines and marks in the finished prints or transparencies which are unacceptable.

The second problem encountered with the traditional system is that the first roll processed ends up on the bottom of the box. In order to get to it to make prints or to mount the slides, the operator needs to extract it from the bottom of the box. Here again is a potential for scratching but even more important is the problem of keeping rolls in the correct sequence for finishing the work order. The traditional box is a last-in, first-out situation which is just the opposite of what is desired for efficient production.

A third problem with the box system is that it has difficulties with longer rolls of film. The traditional boxes are typically only about 2 feet long and a 36-exposure roll of film gets folded several times in order to fit into the box. This folding process in the box can also lead to other problems. If the film is left for any extended time (overnight for example) folded in the box, it will take on the shape of the box. The folds and twists in the film then make it more difficult to run the film through a printer or a slide mounter.

A fourth problem is that it is totally impractical to try to stuff 50 feet or more of film into a 2 foot box. For the long roll processing labs, two typical methods are used. The first is to splice shorter rolls together and attach them to a leader. The leader is threaded through the processor and attached to a take-up reel. The film is then rolled up on a take-up spool as it exits the drier. Another method is to have an operator loading on one end of the film processor and a second operator at the exit end who attaches the film to take-up reels as it exits. This method requires the frequent and constant attention of the operators and is only justified by large scale processing labs.

The FIFO accumulator described below works on a totally different principle from anything that is being done currently in the photographic industry. The accumulator guides the film from the exit of the film processor and through the use of special belts and mechanisms and causes the film to be formed into a loose roll that is not attached to any core or take-up reel. The dried film remains in the center of a pair of hoops and belts that gently support and protect the film until it is removed for the other finishing steps of the process. As additional rolls of film exit the film processor drier, they are added to the outside of the roll being formed in the accumulator. Numerous rolls of any length can be added at any time as they exit the processor drier without operator attention. When the operator needs to remove film from the accumulator, he may merely reach into the center of the hoop and lift out the end of the roll of film and remove it without damage to that roll or any other film that may also be in the accumulator. The natural rolling nature of the accumulator causes the film to want to continuously work its way to the center as more and more film gets added to the outside of the roll. A 12 inch piece of film gets handled just the same as a 50 foot piece of film and they are always keep their exact processing order sequence.

Figure 9:
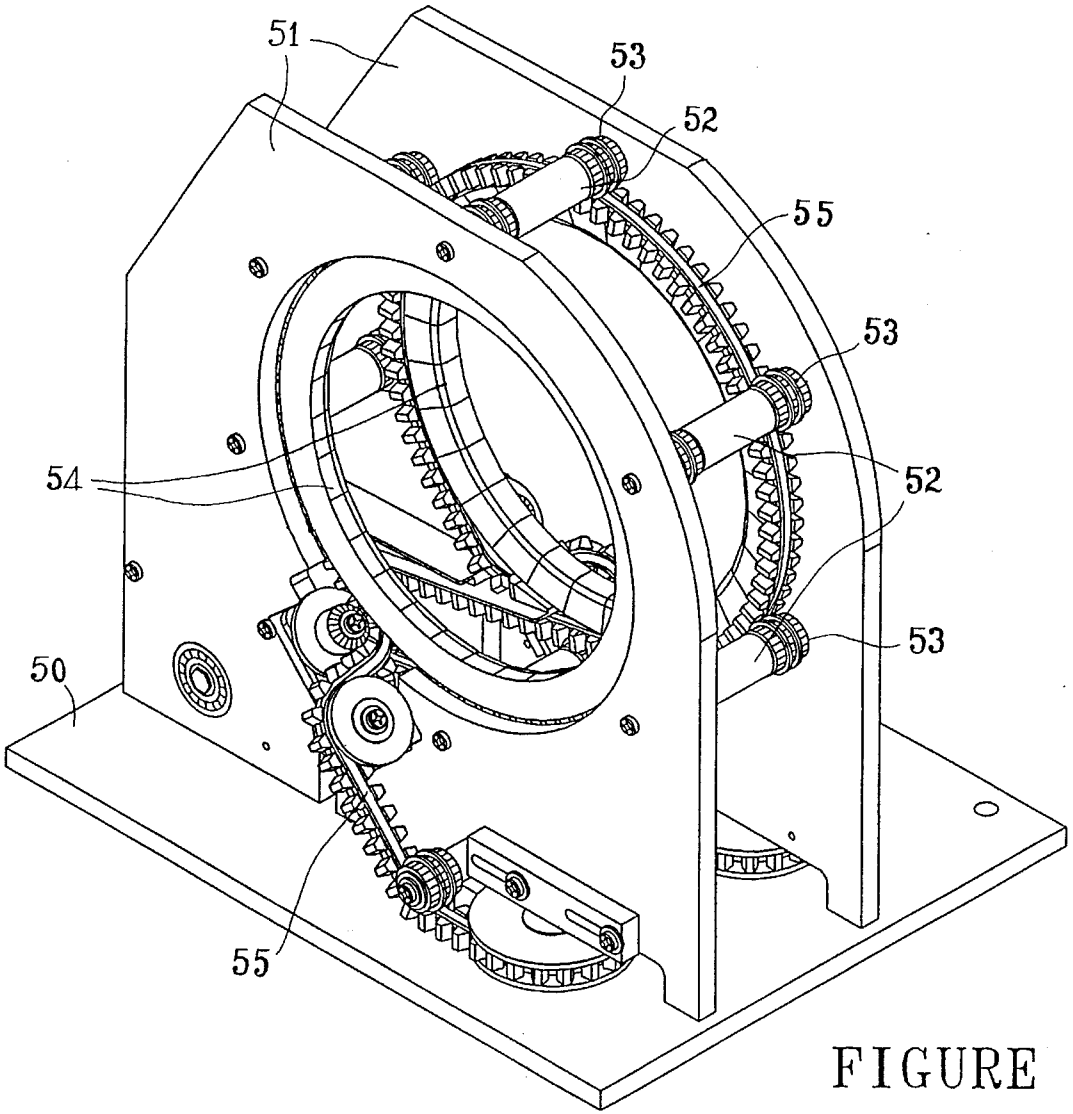
FIG. 9 is a view in perspective of the FIFO film strip accumulator of the present invention.

The FIFO accumulator is a very compact solution to all of the problem situations listed above. Referring now to FIG. 9, there is shown a drawing of the FIFO Accumulator system. The base plate 50 is only 7 inches wide by 9 inches long with the highest point of the device being less than 9 inches tall. The base plate 50 serves as the surface to which the rest of the structure is mounted. The main frame consists of an identical pair of side plates 51 that are attached to the base plate 50. The side plates 51 are spaced apart from each other by spacers 52 and small idler roller 53 assemblies. The spacers 52 consist of a round piece of shaft stock with a reduced diameter area at each end. The length of the reduced diameter area is slightly longer than the length of the idler roller 53. Both ends of the spacers 52 are drilled and tapped. The bore of the idler roller 53 provides a loose fit on the reduced diameter of the spacer 52 and allows the idler roller 53 to turn freely. Details of this assembly can also be noted on section view FIG. 10.

Figure 10:
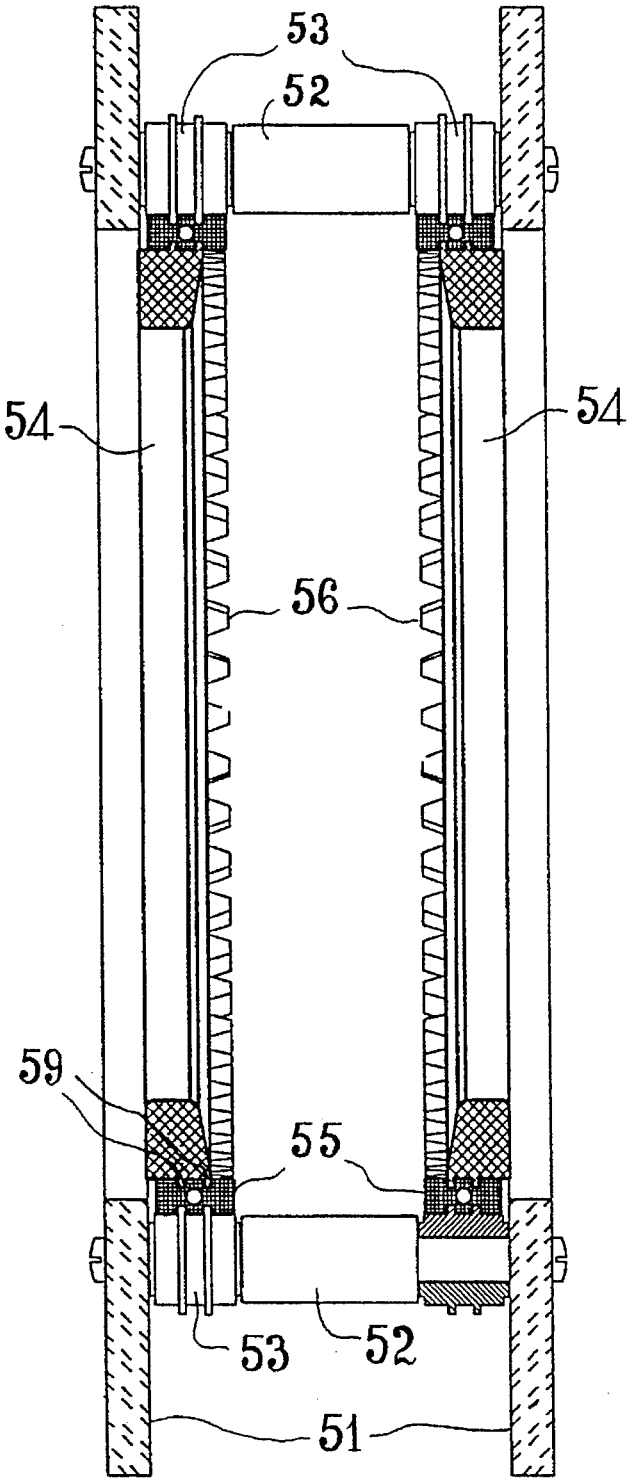
FIG. 10 is an section view of the accumulator of FIG. 9, the section taken through the accumulator central axis transverse to the direction of film travel, seen from the direction of the film entrance to the accumulator.

Referring to FIG. 9 & 10, the transport and drive mechanism consists of sets of components that are mirrors of each other and mounted on their respective side plates 51. One of the components of the system shown in the drawings is the hoop 54. The outside diameter of the hoops 54 has two ribs that stand higher that the main diameter of the body of the hoop. One of the ribs is located on the face of the hoop 54 that faces the center of the accumulator assembly and the second rib is located closer to the center of the outer face of the hoop. The surface of the hoop 54 that faces the center of the accumulator assembly also has a tapered face. The body of the hoop 54 is thicker at the outer diameter and thinner at the inner diameter with a radius leading from the tapered surface to the inside diameter of the hoop. The tapered surfaces on the hoops serve multiple purposes. The spacing of the inside faces of the hoops is such that at the closest point, they are slightly (about 0.020") farther apart than the maximum width of the film being accumulated.

The space between the hoops 54 near the outside diameter of the hoops and above the teeth 56 of the belt 55 is where the film first enters and first starts to accumulate. The belt teeth 56 overhang the edge of the hoop 54 as the belt is wrapped around the hoop. The spacing of the hoops insures that the film is guided into the correct position. As more and more film is wound into the accumulator from the outside, the tapered surfaces inside the hoops 54 give more room for the film to move inward toward the center of the hoops without binding. It is also noted that during operation, that the centermost wraps of film in the loose roll will sometimes "drop toward the center" and make the center of the roll get smaller quicker than expected. The tapered inner surfaces of the hoops 54 create a funnel effect that keeps the end of the film inside the hoops and keeps it from wanting to crawl out of the center of the hoop.

Figure 11A:
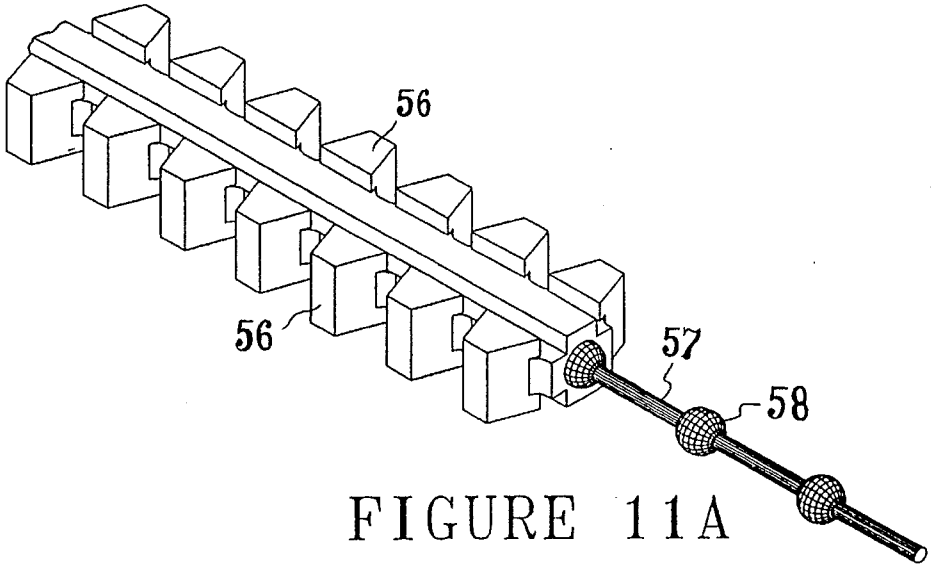
FIG. 11A is a view of a fragment of a transport belt for the accumulator, showing features and details thereof.
Figure 11B:
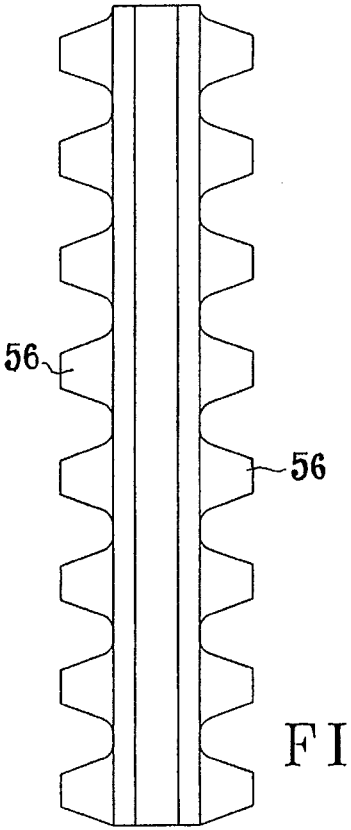
FIG. 11B is a plan view of a portion of a transport belt for the accumulator.
Figure 11C:
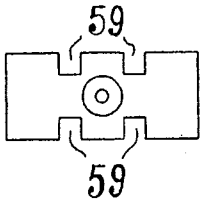
FIG. 11C is a cross section view of a transport belt for the accumulator.

The key element for moving, guiding, and supporting the film and driving the mechanism is the belt 55. Referring now to FIGS. 11A, 11B & 11C, there is shown a drawing of the special belt used for the accumulator. The belts are molded of a soft elastomeric material that will accept flexing in two planes and not take a set around any of the pulleys, hoops or other shapes when left standing for long periods of time without moving. The belt material must be capable of being joined into an endless loop with joints that do not degrade with time or cause any changes of thickness or stiffness of the belt at the joint. Certain families of silicone rubbers have been found to have these properties. Two specific materials are DOW CORNING Tooling Elastomer SG and DOW CORNING Silastic J-RTV Silicone Rubber.

The belts 55 have a number of important elements. The first element of the belt is the central tension member 57. The purpose of this tension member is to insure that the belt cannot be stretched under its normal operating conditions. Tension members may be made of materials such as nylon, polyester or other synthetic fibers that are straight, woven or braided into a stretch-resistant cord.

The belts also need a type of restraint to keep the soft rubber from being bunched up along the tension member. The restraint is provided by a molded ball 58 or similar shape attached to the tension member. The combination of tension member 57 and restraint 58 must not affect the bending action of the belt in any of the working planes that the belt operates in. A material such as metallic bead chain may be suitable in some operations.

The shape of the belt 55 provides many functions. First of all, the profile of the belt must be such that it has equal bending moments in both directions since the transport belt operates in two planes that are at 90 degrees to each other. A belt that does not have equal bending moments will tend to roll over as it changes planes rather than making the transition smoothly. The bending moment in the horizontal plane is determined by the size, shape and spacing of the notches along the edges of the belt as well as the width and thickness of the section of the belt. The bending moment in the vertical plane is determined by the thickness of the section and the size, shape and positioning of the tracking grooves 59 and the overall width of the bendable material.

Another important detail of the belt 55 is the teeth 56 along both of its edges. As noted earlier, the teeth create an integral part of the bending characteristics of the belt as well as creating the surface that supports the film as the belt wraps around the hoop 54. Referring to FIG. 10, it will be noted that the belts 55 are wrapped around the hoops 54 with the tracking grooves 59 engaged with the ribs around the outside of the hoops. The effect is to have the one set of the belt teeth 56 overhanging the hoop into the space between the two hoops 54. This is done in a mirrored fashion between the side plates 51 of the accumulator. This pocket created between the inner surfaces of the hoops and the inside diameter of the ring of teeth of the belt wrapped around the hoop is the pocket that carries the film. This pocket causes the film to form a roll when the entire assembly is rotated about the horizontal axis of the pair of hoops.

As noted earlier, the belts 55 have tracking grooves 59 molded on both faces of the belt. These grooves 59 provide a means for positioning the belt in several locations through out the accumulator assembly. It will be noted in FIG. 10, that the grooves in the belts 55 engage both the ribs on the hoops 54 and ribs on the small idler rollers 53. This engagement of the belts, hoops and idlers is what positions the assembly on the side plates 51. This positioning function can also be noted in FIG. 9.

One feature of the belts 55 that is not easily noted by the casual observer is that the belts are not simple endless hoops. The belts are Mobius loops. A normal endless loop is formed by bringing the ends of a ribbon around and joining them with the edges in alignment with each other. A Mobius loop is formed by bringing the ends of that same ribbon around and twisting one end ½ a turn before joining the ends.

Figure 12:
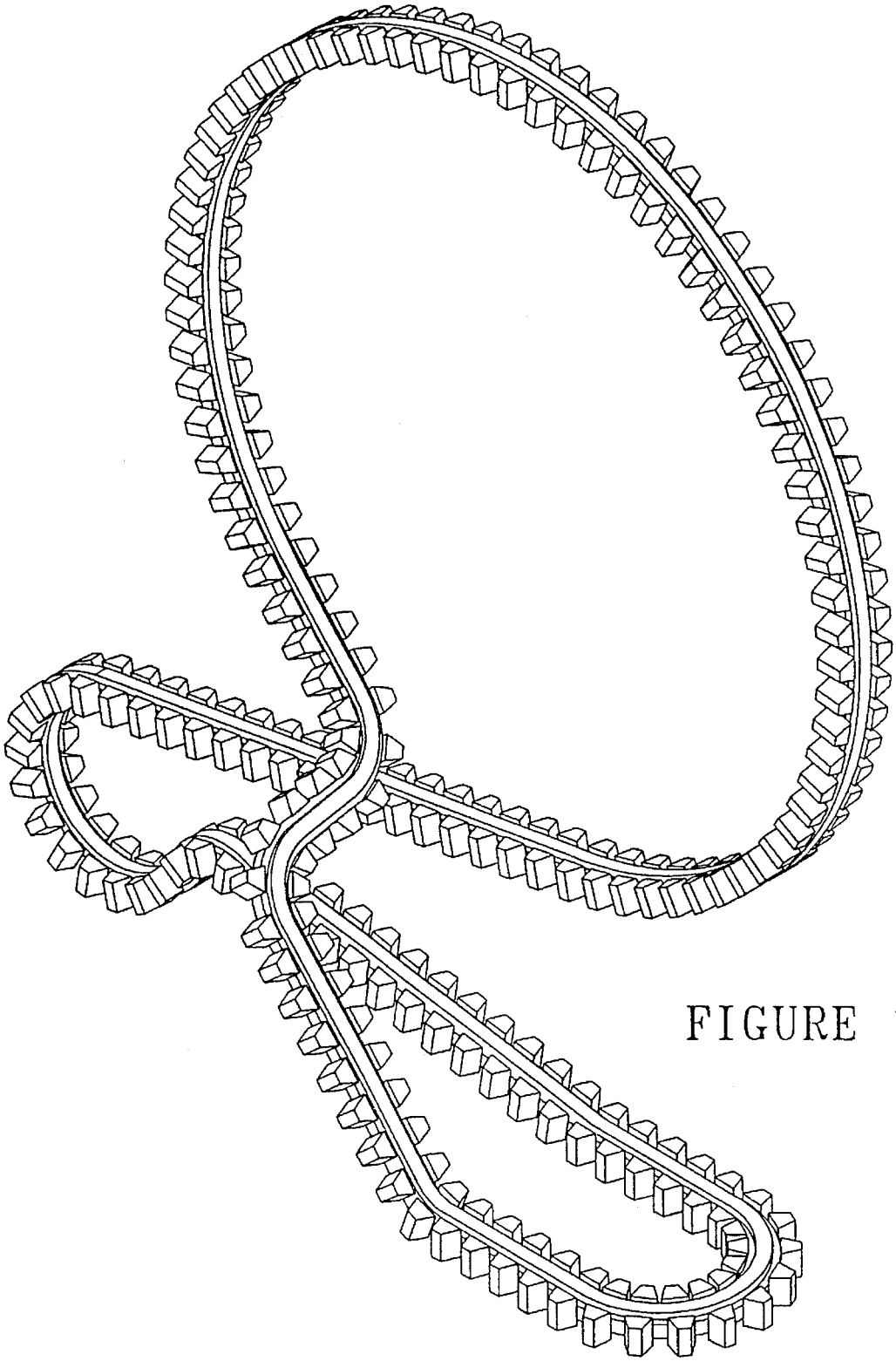
FIG. 12 is a view in perspective of one of the transport belts (the one on the left in FIG. 13) of the accumulator, removed from the accumulator to show the belt path.

Refer now to FIG. 12, which is a drawing of the belt removed from the left side assembly of the FIFO accumulator. It may be demonstrated that it is a Mobius loop by taking a pencil and tracing around one of the faces of the belt. For example, if one starts by going around the inside of the large loop and it will be necessary to have to go around "twice" before getting back to the same starting point. Mathematically it is an object with just one surface. The purpose of the Mobius belt in this application is to keep the belt from "twisting". If a endless flat belt is threaded around the belt path, it will end up with a twist in it. In a short-coupled system like this, the twist leads to the need for many more alignment idler pulleys, more parts, more space more distance and more mechanical drag in the system. A Mobius loop ends up running "flat" in the system with minimum parts and drag. The accumulator contains a "right-hand" and a "left-hand" Mobius loop. One belt has ½ twist to the right and the other has ½ a twist to the left when the belts are manufactured.

Figure 13:
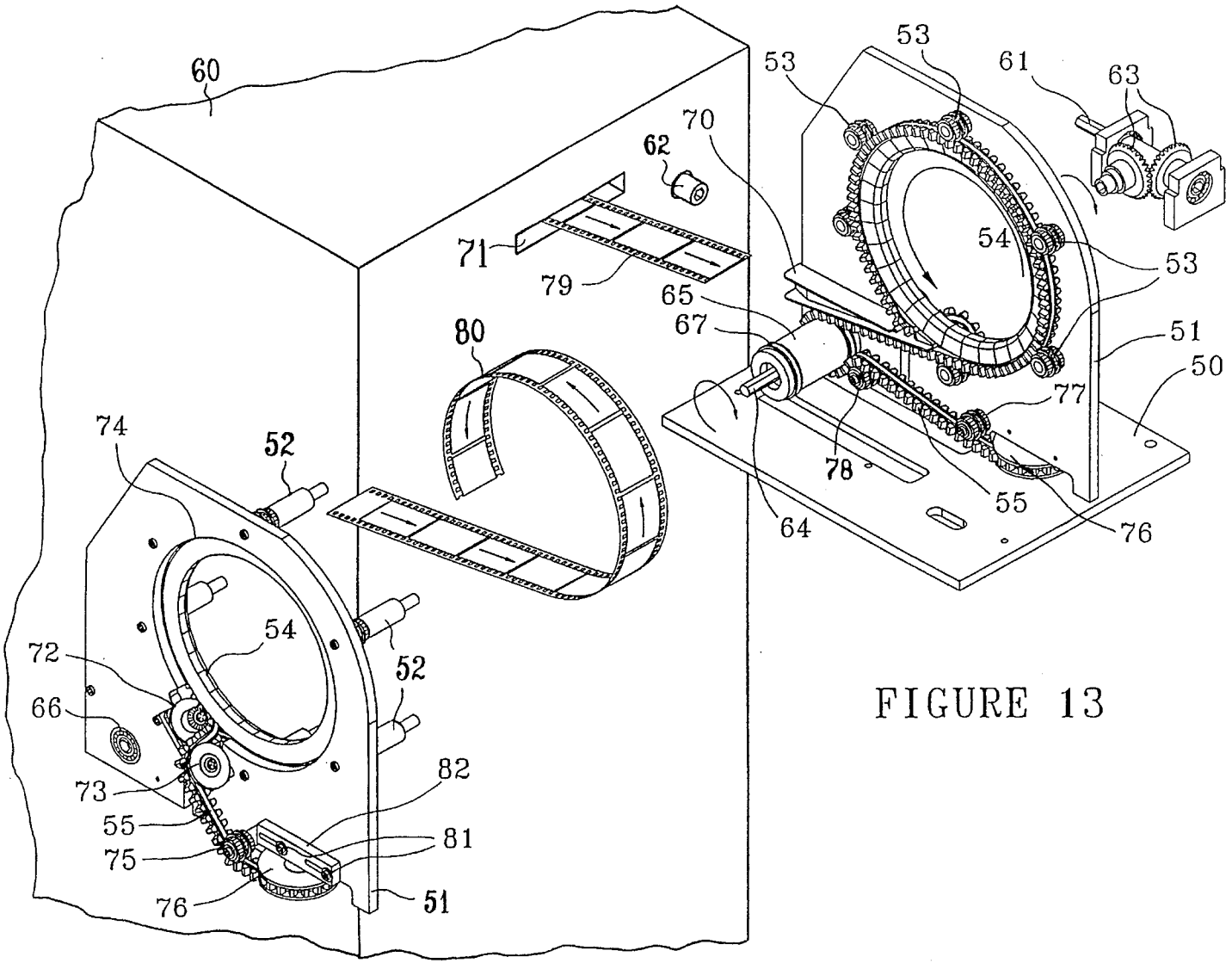
FIG. 13 is an exploded view of the accumulator.

The overall operation of the system can be seen by referring to the exploded view of the system in FIG. 13. Mechanical power enters the accumulator through a drive-shaft 61. The typical film processor 60 that will use the FIFO accumulator has an extension of the main driveshaft 62 that drives the film transport system of the processor. When the accumulator is installed on the processor, the driveshaft 62 of the processor is engaged with the driveshaft 61 of the accumulator. As the speed of the processor is changed to accommodate changes in the process, the accumulator changes speed correspondingly. Power from the driveshaft 61 is transmitted through a pair of miter gears 63 to establish the correct direction of rotation and orientation of the accumulator power shaft 64. The power shaft 64 is securely connected to the drive roller 65. The power shaft 64 is supported and located in the side plates 51 by bearing assemblies 66 in each side plate.

The drive roller 65 provides the driving force to the belts 55 by frictional contact with the drive roller 65. Each end of the drive roller 65 has a pair of ribs 67 around the outer diameter of the drive roller 65 to engage with the tracking grooves 59 of the belts 55. These ribs 67 provide part of the tracking system to keep the belts 55 in proper position and alignment.

Following the belt 55 path through the system will give an indication of how the accumulator operates and how the belts and hoops are able to form the film into continuous roll without attaching the film to a core. Starting at the drive roller 65 which turns in a clockwise direction, the frictional forces between the roller 65 and the belt 55 causes the belt to move around the drive roller. The belt 55 that is coming off of the top diameter of the drive roller 65 passes under the lower surface of the film entrance guide 70. The film entrance guide 70 provides a channel and funnel to take the film from the exit 71 of the processing machine and guide it into the proper loading position for the accumulator. The belt 55 then reaches the lower tangent point of the hoop 54 and starts its wrap around the hoop 54. The ribs around the outer diameter of the hoops 54 engage with the tracking grooves 59 of the belt 55 and positions the belt around the outer diameter of the hoop 54 such that the belt teeth 56 on one edge of the belt will overhang the inside face of the hoop 54. The small idler rollers 53 which are part of the side plate spacers 52 retain the belt and hoop combination in a position that centers the combination over a large diameter opening 74 through side of the side plate 51. The motion of the driven belt 55 causes the hoops 54 to rotate in a counter-clockwise direction.

After the belt 55 has completed approximately ⅞ of a pass around the hoop 54, the belt leaves the hoop along the tangent line of the hoop. The belt 55 then contacts the first exit idler roller 72 that causes the belt to make a turn 90 degrees away from the plane of the hoop 54. The belt passes through the opening 74 in the side plate 51 and contacts the second exit idler roller 73. From here the belt 55 travels around the outside guide idler roller 75 and around the horizontal turn idler roller 76. The belt 55 completes its trip by passing the inside guide idler roller 77 and going over the pinch idler roller 78 and making the final wrap back around the drive roller 65. The pinch idler roller 78 is needed to make sure that the belt 55 makes at least a 180 degree wrap around the drive roller 65 to insure a positive drive force for the belt.

With the belt path established and the directions of travel noted, we now introduce processed photographic film 79 into the system. The film 79 enters the space between the film guides 70 mounted on the internal faces of the side plates 51. The motive power moving the film at this point is the last stage of the transport system of the film processing machine. The leading edge of the film will then enter the space between the hoops 54 just above the lower tangent line of the hoops. By this point in time, the belt 55 is already in contact with the lower tangent line of the hoop 54 and creates a "bottom" for the pocket that will be carrying the film 79. The noted "bottom" is actually a false bottom because when the belt reaches the ⅞ point around the hoop, the belt peels away from the hoop and creates the opening where additional film can enter the interior of the hoop/belt 54/55 pocket.

When the leading edge of the film nears the completion of its first revolution within the hoop/belt 54/55 pocket, it comes to the gap where the belt has exited the hoop via the pair of exit idler rollers 72 & 73. The stiffness of the film will cause the film to continue to travel in a straight line for the short distance when it will come in contact with the portion of the roll of film that is entering the accumulator. The rolling motion of the belt/hoop combination and the angle of contact between the leading edge of the film and the entering film will cause the leading edge of the film to conform to the inside diameter of the film being rolled up. The winding process continues as long as film is exiting the film processor.

Two other actions take place during the winding up process. The first is that the interface between the belt/hoop 55/54 combination defines the maximum outside diameter of the roll of film being wound up. As more and more film is added to the roll, its diameter cannot increase outwardly because of the restraint of the belt teeth 56. A squeezing force is generated because of this and the film slowly creeps toward the center of the roll and builds up the roll from the outside to the inside. The forces needed to do this are greatly reduced by the second action that has been observed in operation. As the accumulator turns, the leading edge of the film will often drift freely toward the center of the hoop as it passes over the top. The leading end of the film will usually contact the inner loop of rolled-up film at a point closer to the leading edge than it had during the formation of the first revolution. This creates a roll that is now a little smaller in diameter than the maximum diameter defined by the belt/hoop combination. The addition of more film to the outside of the roll is not impeded by film already accumulated.

The drive roller 65 is sized such that its outer diameter is large enough to overdrive the belt 55 about 10% faster than the film exiting the film processor. There are several reasons for the overdrive situation. The first is that when the belt 55 speed matches the processor exit speed, the leading edge of the film has a tendency to creep out between the belt teeth 56 during the first ¼ revolution of the hoop 54. By overdriving the belt slightly, the teeth 56 outrun the leading edge of the film and the film cannot find a gap to creep out of. The overdrive action also provides a gentle tug on the film to make sure it is being taken away from the processor drier exit and not permitted to bunch up at the accumulator entrance. Another benefit of the overdrive is to compensate for the expansion and contraction of the film as it goes through the wet-to-dry and hot-to-cold cycle in the drier. A slight overdrive will accommodate the changes in film length and always keep the film moving forward in a positive way.

Belt tension adjustments are made by loosening the screws 81 that attach the belt tension adjuster assemblies 82 to the side plates 51. By moving these assemblies back and forth, which contain the horizontal turn idler rollers 76, the correct tension for proper operation can be achieved. The screws are tighten to retain the setting.

The film 80 which is rolled up in the accumulator is intentionally rolled up with the emulsion (light sensitive) side wound facing away from the center of the roll. Freshly dried film when rolled up in this manner, will tend to layout flatter than film rolled up with the emulsion facing inward. Thus makes the film much easier to handle for the other finishing steps which are to follow. Another advantage of rolling up the film with emulsion outward is that the image side is more protected from damage when the operator reaches into the hoops to remove the accumulated film.

Advantages and benefits of the FIFO film accumulator:

1) Processed film is retained in a First-In, First-Out sequence which enhances work flow in the processing lab.

2) Processed film is rolled up in such a way that is protected from mechanical damage by other film exiting the processor.

3) Processed film is rolled up with the emulsion facing out which reduces the film curling tendencies.

4) Processed film may be removed from the accumulator at the same time as other film is being added to the accumulator.

5) Random lengths of film can be accepted by the accumulator at any time.

6) Operator intervention is never needed to start any piece of film in the accumulator.

7) The FIFO accumulator takes up less space than a box-type film receptor.

8) No reels, cores or tape is required to roll up the processed film exiting the processor.

Other variations of the edge-support belt processor invention are easily possible. One such variation is shown in FIG. 14. This figure shows the invention configured to become a dental X-ray processor. The belts 91 are of the same design and material as disclosed in FIGS. 6A, 6B & 6C. A piece of dental X-ray film 90 is introduced into the film support grooves 45 between the belts 91 and is carried through the processing solutions as the belt traverses it path. The processing solutions are contained in a compartmented tank assembly 92. Since the pieces of dental X-ray film are quite small, it is mechanically difficult to pass the films from one solution to the next with the traditional systems. The belts 91 in this configuration of the invention retain continuous control of the film through out process and then deliver the processed and dried film to a suitable tray that can be formed as part of the top surface of the processor cabinet. Since X-ray films are very small and since they are not intended to be rolled up after processing, this configuration does not require the need of a FIFO accumulator.

Dental X-ray films are made in several sizes and shapes. To accommodate the various widths, a width adjusting system would be provided to control the spacing between the belts.

Advantages and benefits of the edge-support belt transport system for use in an dental X-ray processor are:

1) A very simple mechanical transport compared to the multitude of rollers that are typically used in dental X-ray processors.

2) A dramatic size reduction of the overall processor because of the simple belt transport system.

3) Very low maintenance because the belts need little cleaning and attention compared with the rollers and cross-over guides typically used in current X-ray processors which lowers the cost of operation of the processor.

4) The belt transport system does not create the typical jamming and snagging problems while handing the film from solution to solution that is typical with current roller transport X-ray processors.

5) The small size and shape of the solutions tanks gives greater processing life to the developing solutions for reduced cost of operation of the processor.

I claim:

1. Apparatus for transporting film in a process, comprising:

a pair of flexible belts;

a system of belt supports for holding said belts in spaced relation and for moving said belts in a non-linear film path in said process;

and wherein each of said belts has a groove therealong for receiving an edge of said film therein, said grooves defining a space therebetween wherein said film floats freely vertically and side to side so that said film may be moved guided and transported in said process by intermittent frictional contact with and movement of said belts through said non-linear film path.

2. Apparatus according to claim 1 wherein the flexible belts are made of a flexible rubber material, and include a tension member formed therein and internally secured to resist stretching or bunching of the rubber.

3. Apparatus according to claim 2 wherein said tension member includes a plurality of balls affixed thereon for providing said resistance to stretching or bunching of said rubber material.

4. Apparatus according to claim 2 wherein the belts have equal flexibility in perpendicular planes so as not to twist when bent in different directions.

5. Apparatus according to claim 1 wherein said belts have cog teeth on their sides and wherein said belt support system includes geared wheels for engaging the cog teeth.

6. Apparatus according to claim 5 wherein the belts are in loops, and wherein the belt support system directs the film path from a load zone where the belts are brought from a wide relationship into film edge engagement, through a processing step, and to a film unload zone where the belts are spread away from film edge engagement to discharge the film.

7. Apparatus according to claim 6 further including a plurality of processing steps according to the film process, each step having associated therewith a pair of said belts and their belt support systems, the unload zone of one step being aligned with the load zone of another step, so that film is handed off from one stage of the process to the next.

8. Apparatus according to claim 7 further including an accumulator disposed after the last of said processing steps for receiving and storing film exiting said last processing step.

9. Apparatus according to claim 8 wherein said accumulator comprises:

a pair of supports defining a pair of hoops spaced apart from one another according to the width of film;

a pair of flexible transport belts;

a guide system for said transport belts for moving them through a take-up zone and around said hoops;

means for receiving film from said last processing step at said take-up zone and guiding said film into loose contact with said transport belts;

wherein said hoops and said transport belts are configured to receive and rotate the received film to form a loose roll within said hoops, with the earliest received film on the inside and the latest received film on the outside; and whereby the earliest received film may be reached in the inside of said hoops and withdrawn therefrom.

10. An accumulator for receiving and storing film exiting from a processor, comprising:

a pair of supports defining a pair of hoops spaced apart from one another according to the width of film;

a pair of flexible transport belts;

a guide system for the belts for moving them through a take-up zone, and around the hoops;

means for receiving film at the take-up zone and guiding it into loose contact with the transport belts;

said hoops and belts configured to receive and rotate the received film to form a loose roll within the hoops, with the earliest-received film on the inside and the latest film on the outside; and whereby the earliest-received film may be reached in the inside of the hoops and withdrawn therefrom.

11. An accumulator according to claim 10 wherein the hoops have inside faces which are tapered from a width just wider than the film at the outer portion adjacent the path of the transport belts, to a wider spacing inwardly thereof, as an aid to the movement of film into the loose roll of film being stored within the accumulator.

12. Apparatus according to claim 10 wherein the flexible belts are made of a flexible rubber material, and include a tension member formed therein and internally secured to resist stretching or bunching of the rubber.

13. An accumulator according to claim 12 wherein said tension member includes a plurality of balls affixed thereon for providing said resistance to stretching or bunching of said rubber material.

14. An accumulator according to claim 13 wherein said transport belts have equal flexibility in perpendicular planes such that said transport belts will not twist when bent in different directions.

15. An accumulator according to claim 12 wherein the transport belts are configured as endless loops which move in paths around the hoops and through the loading zone.

16. A belt for transporting film in a process, said belt comprising:

a continuous loop of flexible material;

a tension member formed within said loop which is internally secured to resist stretching or bunching of said flexible material; and wherein said belt has substantially equal flexibility in perpendicular planes so as not to twist when bent in different directions.

17. The belt of claim 16 wherein said loop is constructed in the form of a Mobius loop.

18. The belt of claim 17 wherein said tension member includes a plurality of balls affixed thereon for providing said resistance to stretching or bunching of said flexible material.

19. The belt of claim 17 wherein said loop includes an inner surface, an outer surface opposite said inner surface, and a pair of opposed edges, wherein said inner and outer surfaces include one or more continuous longitudinal tracking grooves formed therein, and wherein said opposed edges include a plurality of notches formed therein transverse to said loop.

20. The belt of claim 19 wherein said loop further includes a continuous longitudinal film groove formed in one of said opposed edges for loosely capturing therein an edge of the film.

* * * * *